US006709542B1

(12) United States Patent
Naito et al.

(10) Patent No.: US 6,709,542 B1
(45) Date of Patent: Mar. 23, 2004

(54) THERMAL TRANSFER RECORDING MEDIUM, IMAGE-FORMING METHOD AND IMAGE-BEARING BODY

(75) Inventors: Akira Naito, Tokyo (JP); Yoshiaki Shiina, Tokyo (JP); Kazumichi Shibuya, Tokyo (JP)

(73) Assignee: Toppan Printing Co., Ltd., Tokyo (JP)

( * ) Notice: Subject to any disclaimer, the term of this patent is extended or adjusted under 35 U.S.C. 154(b) by 29 days.

(21) Appl. No.: 09/669,674

(22) Filed: Sep. 26, 2000

(30) Foreign Application Priority Data

| | | |
|---|---|---|
| Sep. 30, 1999 | (JP) | 11-278944 |
| Feb. 1, 2000 | (JP) | 2000-024252 |
| Feb. 1, 2000 | (JP) | 2000-024254 |
| Feb. 8, 2000 | (JP) | 2000-030516 |

(51) Int. Cl.[7] ..... B41M 5/00

(52) U.S. Cl. ..... 156/235; 428/32.69; 428/32.76; 428/32.86

(58) Field of Search ..... 8/471; 428/195, 428/413, 500, 522, 913, 914, 331, 206, 32.69, 32.76, 32.86; 503/227; 156/235

(56) References Cited

U.S. PATENT DOCUMENTS

| | | | | |
|---|---|---|---|---|
| 4,912,084 A | * | 3/1990 | Kanto et al. | 503/227 |
| 4,923,846 A | * | 5/1990 | Kutsukake et al. | 503/227 |
| 5,071,502 A | | 12/1991 | Hashimoto et al. | 156/234 |
| 5,714,249 A | | 2/1998 | Yoshida et al. | 428/327 |
| 5,726,698 A | | 3/1998 | Shinozaki et al. | 347/172 |
| 5,741,583 A | | 4/1998 | Yoshida | 428/327 |
| 5,888,644 A | | 3/1999 | Yoshida et al. | 428/323 |

FOREIGN PATENT DOCUMENTS

| | | | |
|---|---|---|---|
| EP | 0 649754 A1 | | 4/1995 |
| EP | 0 743195 A1 | | 11/1996 |
| JP | 61-244592 | | 10/1986 |
| JP | 63 056490 A | * | 3/1988 |
| JP | 63-95988 | | 4/1988 |
| JP | 63-65029 | | 12/1988 |
| JP | 4-305492 | | 10/1992 |
| JP | 7-117359 | | 5/1995 |
| JP | 9-11635 | | 1/1997 |
| JP | 9-24679 | | 1/1997 |
| JP | 9-99644 | | 4/1997 |

* cited by examiner

*Primary Examiner*—Bruce H. Hess
(74) *Attorney, Agent, or Firm*—Staas & Halsey LLP

(57) ABSTRACT

A thermal transfer recording medium including a substrate, and a thermal transfer recording layer formed on the substrate and mainly containing a coloring pigment, an amorphous organic high polymer and colorless or light-colored fine particles, the thickness of the thermal transfer recording layer being in the range of 0.2·m to 1.0·m, wherein the mixing ratios of the coloring pigment, the amorphous organic high polymer and the fine particles are confined to 20–60 parts by weight, 40–70 parts by weight and 1–30 parts by weight, respectively. An image-forming method using the thermal transfer recording medium, and an image-bearing body formed from the thermal transfer recording medium are also disclosed.

8 Claims, 3 Drawing Sheets

THERMAL TRANSFER RECORDING MEDIUM, IMAGE-FORMING METHOD AND IMAGE-BEARING BODY

CROSS-REFERENCE TO RELATED APPLICATIONS

This application is based upon and claims the benefit of priority from the prior Japanese Patent Applications No. 11-278944, filed Sep. 30, 1999; No. 2000-024252, filed Feb. 1, 2000; No. 2000-024254, filed Feb. 1, 2000; No. 2000-030516, filed Feb. 8, 2000, the entire contents of which are incorporated herein by reference.

BACKGROUND OF THE INVENTION

This invention relates to a thermal transfer recording medium, to an image-forming method using the thermal transfer recording medium, and to an image-bearing body to be formed from the thermal transfer recording medium. In particular, this invention relates to a thermal transfer recording medium for forming, on an image-receiving sheet, an areal gradation color image by superimposing at least two colors by thermal transfer, in accordance with image data, using a thermal head printer; to an image-forming method using the thermal transfer recording medium; and to an image-bearing body formed from the thermal transfer recording medium.

With respect to the thermal transfer recording system for forming a gradation image by using a thermal head printer, two transfer systems are known to date, i.e. a sublimation transferring system and a melt transferring system.

According to the sublimation transferring system, a thermal transfer recording medium having, on a substrate, a thermal transfer recording layer comprising a sublimating (thermally transferring) dye and a resinous binder is superimposed on an image-receiving sheet. The sublimating dye in the thermal transfer recording layer is allowed to transfer, in accordance with the quantity of heat from a thermal head, to the image-receiving sheet, thereby forming a gradation image.

However, when an image is formed by using a sublimating dye, the image formed is generally poor in durability, so that the application of the sublimation transferring system to the fields where excellency in heat resistance or light-resistance of printed image is demanded would be limited. Further, the thermal transfer recording medium employed in the sublimation transferring system is defective in that since the thermal recording sensitivity of the thermal transfer recording medium is poor as compared with the recording medium employed in the melt transferring system, the thermal transfer recording medium is not suited for use as a high-speed recording material employed in a recording system using a high-resolution thermal head which is expected to be actually employed in future for the miniaturization and lightening of a printer operated with high printing energy and driven by a battery such as a dry battery.

On the other hand, according to the melt transferring system, a transfer sheet bearing, on a substrate, a thermally meltable ink transfer layer comprising a colorant such as dye or pigment and a binder such as wax is superimposed on an image-receiving sheet. Energy is applied to a heating device such as a thermal head in accordance with an image data so as to melt-bond the ink transfer layer to the image-receiving sheet, thereby forming an image. The image formed by the melt-transferring system is excellent in concentration and sharpness and is suited for use in recording a binary image such as letters and linear image.

Further, the melt transferring system can be employed for forming a color image by using a thermal transfer sheet bearing yellow, Magenta, cyan and black ink regions, the thermal transfer sheet being subsequently superimposed on an image-forming sheet so as to obtain a color image. Such a thermal transfer sheet for forming a color image is disclosed in Japanese Patent Publication 63-65029.

However, in the case of the thermal transfer sheet disclosed in this Japanese Patent Publication 63-65029, since a crystalline wax having a low melting point is employed as a binder for the ink layer, the blurring of ink tends to occur, thereby deteriorating the resolution of image. Additionally, the fixing strength of the image transferred is relatively weak, so that when an image portion is strongly rubbed with a finger, the image portion may be removed away.

With a view to solve this problem, various methods have been proposed. For example, a heat sensitive transfer sheet bearing a heat sensitive ink layer comprising not less than 65% of amorphous polymer, a releasable material and a colorant is proposed in Japanese Patent Application Disclosure (Kokai) 61-244592. However, even in the case of the heat sensitive transfer sheet disclosed in this Japanese Patent Disclosure, since a crystalline wax is included in the ink layer, the fixing strength of the portion where a plurality of color images is superimposed is still insufficient.

BRIEF SUMMARY OF THE INVENTION

This invention has been made in view of the aforementioned problems accompanying the prior art, and therefore, an object of this invention is to provide a thermal transfer recording medium which is capable of preventing the resolution of image from deteriorating due to a blur of ink due to the use of crystalline wax of low melting point, and also capable of inhibiting the deterioration of durability of an image that may be caused by the employment of such a wax.

Another object of this invention is to provide a thermal transfer recording medium which is excellent in sharp cutting property of the transfer recording layer upon thermal transferring, is high in optical density of transferred image, and is excellent in halftone expression based on areal gradation of dots.

Another object of this invention is to provide an image-forming method using such a thermal transfer recording medium.

A further object of this invention is to provide an image-bearing body formed by using such a thermal transfer recording medium.

In an attempt to achieve the above object, the present inventors have made intensive studies to find that a thermal transfer recording layer containing a coloring pigment as a colorant, an amorphous organic polymer as a binder, instead of wax, and colorless or light-colored fine particles, at a specific ratio, can exhibit desired properties. The present invention is based on this finding.

Accordingly, this invention provides a thermal transfer recording medium comprising, on a support, a thermal transfer recording layer which contains, as a main constituent, a coloring pigment, an amorphous organic polymer and colorless or light-colored fine particles, and which has a thickness of 0.2 $\mu$m to 1.0 $\mu$m, the recording layer contains the coloring pigment, the amorphous organic high polymer and the fine particles at a weight ratio of 20–60 parts by weight: 40–70 parts by weight: and 1–30 parts by weight.

According to this invention, there is also provided a method of forming an image by means of a thermal head printer and by using the thermal transfer recording medium of this invention, the method comprising thermally transferring the thermal transfer recording layer to an image-receiving sheet having an image-receiving surface by means of a thermal head printer in accordance with image data to thereby form an areal gradation image, wherein the image-receiving surface of the image-receiving sheet is constituted by the same type of amorphous organic polymer as the amorphous organic polymer included in the thermal transfer recording layer.

According to this invention, there is also provided an image-bearing body comprising an image carrier, and an image region formed on the image carrier, wherein the image region is formed from a thermal transfer recording layer of the thermal transfer recording medium of this invention.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE EMBODIMENTS

Figure 1:
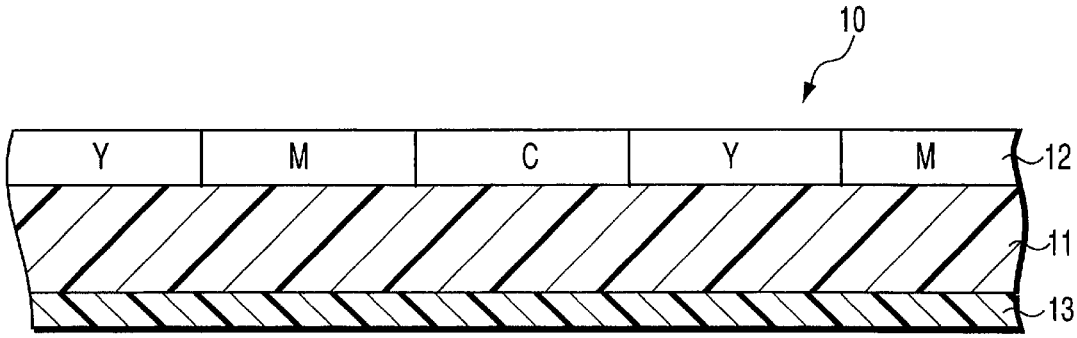
FIG. 1 is a schematic cross-sectional view illustrating a thermal transfer recording medium according to a first embodiment of this invention.

The principle of transferring the thermal transfer recording medium according to this invention resides in that the thermal transfer recording layer thereof is heated by a heating medium such as a thermal head, thereby causing the amorphous organic polymer in the thermal transfer recording layer to become a softened or semi-molten state rather than a thermally molten state, so as to allow the thermal transfer recording layer to develop the stickiness thereof to an image-receiving sheet and concurrently to dwindle the adhesivity thereof to the support supporting the recording layer, whereby the thermal transfer recording layer is allowed to adhere onto the image-receiving sheet, thus recording an image. It is assumed that this transferring is closely related to the fact that the thickness of the thermal transfer recording layer is very small, so that this transferring can be said to operate in a thermal adhesion/thin film peeling mode (see Japanese Patent Application disclosure 7-117359), rather than the traditional so-called heat-melt transfer system.

According to this thermal peeling system of adhered thin film, it is possible to obtain a sharp image which is free from blur of ink when the printing of image is performed by superimposing at least two colors. Further, the image thus transferred is excellent in mechanical strength and also in halftone expression based on areal gradation of dots.

The thermal transfer recording medium according to this invention has a thermal transfer recording layer on a support.

As for the materials useful for the support supporting the thermal transfer recording layer of this invention, those that are generally employed for the thermal transfer recording medium in the sublimation transferring system or in the melt transferring system can be employed. Specific examples of such materials include plastic films made of polyethylene terephthalate (PET), polyethylene naphthalate, polypropylene, cellophane, polycarbonate, polyvinyl chloride, polystyrene, polyimide, nylon or polyvinylidene chloride; and paper such as condenser paper, paraffin paper, etc., with polyethylene terephthalate which is a saturated polyester being most preferred.

The support is generally of an elongated configuration (a ribbon-like configuration) and has a thickness ranging from 2 to 50 $\mu$m in general, preferably ranging from 2 to 16 $\mu$m, more preferably ranging from 2 to 10 $\mu$m.

The thermal transfer recording layer supported on the support is mainly comprised of a coloring pigment, an amorphous organic polymer and colorless or light-colored fine particles, and has a predetermined thickness.

The amorphous organic polymer incorporated in the thermal transfer recording layer should preferably has a softening point in a range of from 70° C. to 150° C., in view of printability to a heating medium such as a thermal head and the fastness or durability of image after the transfer recording.

The heating condition upon thermally transferring the thermal transfer recording layer to an image-receiving sheet, using a thermal head, is approximately a period of several milliseconds at a temperature ranging from 180 to 400° C. Further, as mentioned above, the amorphous organic polymer is required to be turned into a softened or semi-molten state upon thermal transferring. Therefore, when the quantity of heat supplied from a thermal head as well as the softened or semi-molten state of amorphous organic polymer are taken into consideration, the preferable upper limit of melting point of amorphous organic polymer would be 150° C. If an amorphous organic polymer having a melting point exceeding 150° C. is employed, a larger quantity of energy may be required for the thermal transferring, thereby greatly shortening the life of thermal head. The preferable lower limit of the melting point of amorphous organic high polymer is set to be 70° C. in view of the stability of the transferred image. When an amorphous organic high polymer having a melting point of less than 70° C. is employed, an unfavorable phenomenon such as tailing would be generated when the transferred image is rubbed with a finger. In some cases, the amorphous organic high polymer can be characterized by its glass transition temperature. In such a case, the glass transition temperature of amorphous organic polymer should preferably be within the range of from 40 to 150° C.

Specific examples of the amorphous organic polymer which can be used in this invention include epoxy resins, acrylic resins and vinyl chloride/vinyl acetate copolymer resins.

The epoxy resin employed in this invention should preferably have, in addition to a softening point ranging from 70 to 150° C. as mentioned above, an epoxy equivalent (number of grams of a resin containing 1g of epoxy group) ranging from 600 to 5000, and a weight average molecular weight ranging from 800 to 5000. If the epoxy equivalent of epoxy resin is less than 600, the fastness or durability of the transferred image may become insufficient, so that when the image is rubbed with a finger, a tailing of image would be readily generated. On the other hand, if the epoxy equivalent is more than 5,000, the heat energy used for transferring may become too excessive (it may be said that the sensitivity for thermal transferring is deteriorated), thereby greatly shortening the life of the thermal head, and, additionally, the recording layer can no more be suitably employed for a high speed thermal transfer recording of image. Likewise, if the weight average molecular weight of epoxy resin is lower than 800, the fastness of the transferred image may become insufficient, so that when the image is rubbed with a finger, a tailing of image may be readily generated. On the other hand, if the molecular weight is larger than 5,000, the heat energy required for transferring may become too excessive, thereby greatly shortening the life of the thermal head, and additionally, the recording layer can no more be suitably employed for a high speed thermal transfer recording of image.

Therefore, a most preferable epoxy resin would have a softening point ranging from 70 to 150° C., an epoxy equivalent ranging from 600 to 5000, and a weight average molecular weight ranging from 800 to 5000.

Specific examples of such an epoxy resin include diglycidyl ether type epoxy resins such as bisphenol A diglycidyl ether, bisphenol F diglycidyl ether, resorcin diglycidyl ether, cresol novolak polyglycidyl ether, tetrabromobisphenol A diglycidyl ether and bisphenol hexafluoroacetone glycidyl ether; glycidyl ester type epoxy resins such as diglycidyl phthalate ester and diglycidyl dimerate ester; glycidyl amine type epoxy resins such as triglycidyl isocyanurate, tetraglycidylaminodiphenylmethane and tetraglycidylmethaxymenediamine; and aliphatic epoxy resins such as hexahydrobisphenol A diglycidyl ether, polypropylene glycol diglycidyl ether and neopentylglycol diglycidyl ether. These epoxy resins can be employed singly or in combination of two or more of these.

The acrylic resin employed in this invention should preferably have a glass transition temperature (Tg) ranging from 40 to 100° C. If an acrylic resin having a Tg exceeding 100° C. is employed, the heat energy required for transferring may become too excessive, thereby greatly shortening the life of the thermal head. On the other hand, if an acrylic resin having a Tg of less than 100° C. is employed, the resultant image may become poor in fastness, so that when the image is rubbed with a finger, a tailing of the image may be readily generated.

Further, the acrylic resin should preferably have a weight average molecular weight ranging from 2000 to 50000. If the weight average molecular weight of acrylic resin is less than 2000, the fastness of the resultant image may become poor, so that when the image portion is rubbed with a finger, a tailing of the image would be readily generated. On the other hand, if the weight average molecular weight of acrylic resin is higher than 50000, the sharp cutting property of the thermal transfer recording layer may be deteriorated, thus deteriorating the transferring property thereof, the reproducibility of shapes and sizes of the dots is lowered, and at the same time, the resolution of the image obtained would be deteriorated.

Therefore, a most preferable acrylic resin would have a glass transition temperature ranging from 40 to 100° C. and a weight average molecular weight ranging from 2000 to 50000.

Specific examples of such an acrylic resin employed in this invention include homopolymers or copolymers of acrylic monomers such as (metha)acrylic acid, methyl (metha)acrylate, ethyl (metha)acrylate, propyl (metha) acrylate, isopropyl (metha)acrylate, amyl (metha)acrylate, butyl (metha)acrylate, octyl (metha)acrylate, stearyl (metha)acrylate, decyl (metha)acrylate, and (metha) acrylonitrile; as well as a copolymer of such an acrylic monomer or monmers with other copolymerizable monomer (for example, styrene, butadiene). These acrylic resins can be employed singly or in combination of two or more of these.

The vinyl chloride/vinyl acetate copolymer resin employed in this invention has a vinyl chloride unit and a vinyl acetate unit, and preferably has a Tg of from 50 to 90° C. More preferably, the vinyl chloride/vinyl acetate copolymer resin should further have a weight average molecular weight ranging from 10000 to 20000. If the weight average molecular weight of vinyl chloride/vinyl acetate copolymer resin is less than 10000, the stability of the copolymer may become poor so that the discoloration (turned into yellow, brown or black) of the copolymer would more likely be caused due to the decomposition thereof at room temperature. In addition, the resistance to rubbing of the image may become insufficient, so that when the image portion is rubbed with a finger, a tailing of image would be readily generated. On the other hand, if the weight average molecular weight is larger than 20000, the sharp cutting property of the thermal transfer recording layer would be deteriorated, thus deteriorating the transferring property thereof, and at the same time, the resolution of the image obtained would be deteriorated.

The vinyl chloride/vinyl acetate copolymer resin employed in this invention would be useful as long as it contains the vinyl chloride unit and vinyl acetate unit in an amount of 70% by weight or more in total. The balance may be constituted by other vinyl monomers. In particular, a vinyl chloride/vinyl acetate copolymer resin containing 1 to 5% by weight of maleic acid unit is especially preferable since it will provide an image excellent in alcohol resistance.

The coloring pigment incorporated in the thermal transfer recording layer may be any pigment known per se in the art. For example, for the purpose of monochromatic black printing, the employment of carbon black is more preferable, whereas for the purpose of multicolor printing, the thermal transfer recording layer is constituted by a yellow region, a magenta region, a cyan region, and if required, a black region, which are successively arrayed along the longitudinal direction of the support. The pigment colorant constituting each color region may be a single pigment or a mixture of pigments. These pigments included in the thermal transfer recording layer should preferably have an average particle diameter ranging from 50 to 500 nm. If this average particle diameter of pigment is less than 50 nm, the light resistance thereof which is one of the advantages of pigment would be deteriorated. On the other hand, if this average particle diameter of pigment exceeds 500 nm, the coloring property of pigment would be deteriorated, thus making it difficult to obtain a sufficient optical density.

The average particle diameter of pigment can be measured by making use of AUTOSIZER available from MARVERUN Co., Ltd., based on light-scattering system, Coulter counter method, the processing of SEM observation image, etc.

The colorless or light-colored fine particles incorporated in the thermal transfer recording layer of this invention are essential for improving the transferability of the thermal transfer recording layer upon thermal transferring, in particular, for improving the configuration of dots forming the transferred image or the gradation or tone reproduction. The colorless or light-colored fine particles are used so as not to mask the color of the colored image formed by the thermal transferring. Examples of the colorless or light-colored fine particles include silica, calcium carbonate, kaolin, clay, starch, zinc oxide, Teflon powder, polyethylene powder, polymethylmethacrylate beads, polyurethane beads, benzoguanamine and melamine resin beads Among them, silica fine particle is most preferable.

As explained above, the colorless or light-colored fine particles are employed for the purpose of improving the transferability (sharp cutting property) of the thermal transfer recording layer. The colorless or light-colored fine particles should preferably have an average particle diameter ranging from 10 to 300 nm. If this average particle diameter of the fine particles is larger than 300 nm, it may not substantially contribute to the improvement of sharp cutting of the recording layer, and the color development of the color image thermally transferred may be obstructed.

It is preferable that the average particle diameter of the colorless or light-colored fine particles is smaller than that of the coloring pigment used. When the average particle diameter of the fine particles is smaller than that of the coloring pigment, a prominent improvement in sharp cutting property of the thermal transfer recording layer, which the coloring pigments would fail to achieve when they are employed exclusively, can be realized without obstructing the coloring property of pigments. More specifically, the configuration of dots forming the transferred image or the tone reproduction can be extremely improved by using the fine particles. Additionally, since the average particle diameter of the fine particles is small, the weakening of adhesive strength of the recording layer to an image-receiving layer can be minimized as compared with the case where the quantity of color pigments is correspondingly increased.

The thermal transfer recording layer of this invention contains the coloring pigment, the amorphous organic polymer and the fine particles at a ratio of 20–60 parts by weight: 40–70 parts by weight: 1–30 parts by weight.

When the content of the amorphous organic polymer is smaller than the aforementioned range, the mechanical strength of the thermal transfer recording layer would more likely be deteriorated. On the other hand, if the content of the amorphous organic polymer is more than the aforementioned range, the transferability of the thermal transfer recording layer, in particular, the configuration of dots forming the transferred image or the tone reproduction would more likely be deteriorated. If the content of the colorless or light-colored fine particles is less than the aforementioned range, it would be almost identical to the case where no fine particles are added, so that the transferability of the thermal transfer recording layer, in particular, the configuration of dots forming the transferred image or the tone reproduction, would more likely be deteriorated. On the other hand, if the content of fine particles is more than the aforementioned range, it would become difficult to obtain an excellent fluidity of ink. Further, since the content of fine particles becomes much larger than that of pigments, the coloring property of the pigments would be deteriorated and at the same time, the adhesiveness thereof to the image-receiving layer upon thermal transferring would be also deteriorated. As a result, the fixability at the superimposed portion of colors would be deteriorated in particular, thus affecting the fastness of the resultant image.

Preferably, the thermal transfer recording layer of this invention contains the coloring pigment, the amorphous organic polymer and the fine particles at a ratio of 20–30 parts by weight: 40–70 parts by weight: 1–30 parts by weight. More preferably, the coloring pigments should be contained in the recording layer in an amount of 20–30% by weight. If the content of coloring pigments is less than 20% by weight, it will become difficult to obtain an image of desired optical density. On the other hand, if the content of coloring pigments is more than 30% by weight, the adhesive strength of the recording layer would be deteriorated upon thermal transferring, so that the fixability at the superimposed portion of colors would be deteriorated in particular, thus affecting the fastness of image.

In addition to the aforementioned main constituent (the coloring pigment, the amorphous organic polymer and the fine particles), the thermal transfer recording layer of this invention may further contain, if desired, other various additives such as a pigment-dispersing agent, a coated film-stabilizing agent, an antioxidant, an antistatic agent, a sensitizer, etc. In this case, the amount of these additives should preferably be within the range of not more than 10 parts by weight based on 100 parts by weight of the total quantity of the main constituent. In other words, the thermal transfer recording layer of this invention contains the main constituent in an amount of 90% by weight or more.

The thermal transfer recording layer has a thickness of 0.2 to 1.0 $\mu$m. If the thickness is less than 0.2 $\mu$m, it may become difficult to obtain a sufficient color density. On the other hand, if the thickness is larger than 1.0 $\mu$m, the transferring thereof in accordance with the heating portion of the thermal head would become difficult, in particular, the configuration of dots forming a transferred image or the areal gradation reproduction would more likely be deteriorated. More preferably, the thermal transfer recording layer has a thickness of 0.3 to 0.8 $\mu$m.

The thermal transfer recording layer of this invention can be formed by a procedure wherein a composition containing the coloring pigment, the amorphous organic polymer, the colorless fine particles and optionally the other additives noted above, all of which are dispersed or dissolved in a solvent, is coated on the surface of the support by means of a solvent coating method such as bar coating, blade coating, air knife coating, gravure coating or roll coating to obtain a coated layer, which is then dried to form a thermal transfer recording layer.

To form an image using the thermal transfer recording medium of this invention, the thermal transfer layer is transferred to an image-receiving sheet having an image-receiving surface in accordance with image data, using a thermal head printer. The thermal head directly contacts the reverse surface of the recording medium where the thermal transfer layer is not formed, thereby giving heat to the thermal transfer layer. On this occasion, for the purpose of preventing the smooth traveling of the thermal transfer recording medium from being obstructed due to the adhesion of the thermal head to the support, it is preferable to form a back coat layer on the reverse surface of the support which is opposite to the surface where the thermal transfer recording layer is formed.

As for the materials useful for constituting the back coat layer, it is possible to employ silicone oil-containing nitrocellulose, silicone oil-containing saturated polyester resin (e.g., PET resin), silicone oil-containing acrylic resin, silicone oil-containing vinyl resin, or silicone-modified resin. It is also possible to co-use a crosslinking agent for the purpose of improving the heat resistance of the back coat layer. The thickness of the back coat layer may preferably be about 0.1 to 4 $\mu$m.

FIG. 1 is a schematic cross-sectional view of the thermal transfer recording medium of this invention. The thermal transfer recording medium 10 has an elongated ribbon-like support 11, on one surface of which a yellow region (Y), a magenta region (M) and a cyan region (C) are successively formed adjacent to each other along the longitudinal direction of the support 11. These regions Y, M and C constitute the recording layer 12. In other words, the thermal transfer recording layer 12 is segmented into these regions Y, M and C. On the reverse surface of the support 11, there is formed a back coat layer 13.

Figure 2:
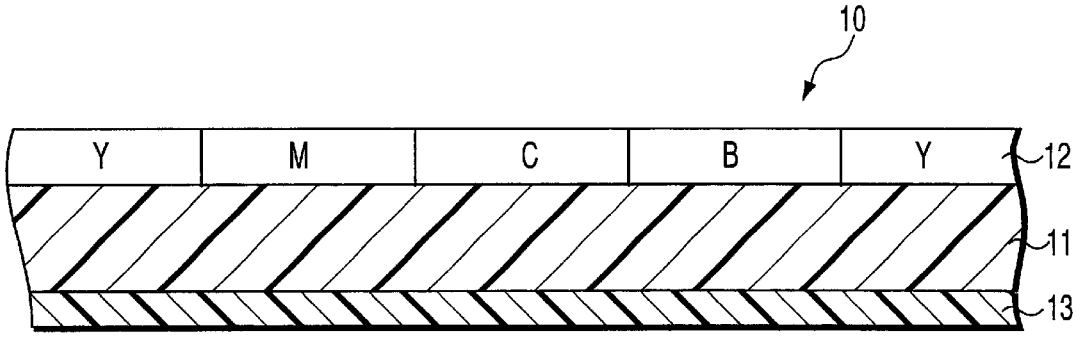
FIG. 2 is a schematic cross-sectional view illustrating a thermal transfer recording medium according to a second embodiment of this invention.

FIG. 2 shows a thermal transfer recording medium 10, which is constructed in the same manner as in FIG. 1, except that a black region or regions (B) are further formed in addition to the regions Y, M and C. These regions Y, M, C and B are successively formed adjacent to each other along the longitudinal direction of the support 11.

Although not shown in the FIGURES, other thermal transfer recording layer or layers for various purposes may be additionally formed on the support 11, if desired. Such other recording layer includes an adhesive transfer layer which has thermal transferability and acts as an adhesive layer when transferred to the image-receiving sheet, a forgery-proof layer which has thermal transferability, and exhibits forgery-preventing effect or allows for easy discovery of forgery, when transferred to the image-receiving sheet, or a special effect layer such as a transferable hologram layer or a transferable diffraction grating layer which has thermal transferability, and exhibits a special decorative effect when transferred to the image-receiving sheet. Such other recording layer(s) may not be necessary to meet the requirements of the recording layer of the invention.

It should be noted that the forgery-proof layer noted above importantly has fine particulate or flake materials incorporated therein. Examples of such materials include fluorescent or phosphorescent materials which emit fluorescence or phosphorescence when irradiated with electromagnetic radiation of certain wavelength (such as UV light, IR light or visible light), electromagnetic radiation-absorbing materials which readily absorb electromagnetic radiation of certain wavelength (such as IR light), or magnetic materials which have magneticity.

As for the materials for the image-receiving body or sheet employed in forming an image by using the thermal transfer recording medium of the invention, it is possible to employ paper such as wood free paper, or coated paper; plastic film such as saturated polyester film (PET film), polyvinyl chloride film, or polypropylene film; or paper or plastic film substrate coated with an image-receiving layer. Further any substrate sheet may be used if it is coated with a suitable image-receiving layer.

The image-receiving layer employed herein should preferably contain, as a main component, the same kind of amorphous organic polymer as the amorphous organic polymer included in the thermal transfer recording layer. When the image-receiving layer is constructed in this manner, the thermal transfer recording layer would be enabled to excellently contact with the image-receiving layer by the heat of the thermal transferring even if the thermal transfer recording layer of the thermal transfer recording medium is not sufficiently fused upon thermal transferring. As a result, the printing can be effected with a sufficient sharp cutting, thereby improving the transferability of the thermal transfer recording layer, in particular, the configuration of dots forming the transferred image or the tone reproduction. Additionally, the image thus formed would become excellent in fastness of image such as abrasion resistance and scuff resistance.

Note that the dots transferred from the recording layer of the invention has substantially the same thickness as that of the recording layer (due to the thermal adhesion/thin film peeling mode noted above).

Here, "main component", when referring to the amorphous polymer in the image-receiving layer, means that the polymer is contained in an amount larger than any other components.

Further, when it is difficult to directly form an image on a desired sheet (or body) on which the image is desired to be ultimately formed, due to, for example, the nature of the sheet or irregularities or roughness of the sheet surface, the image may be once formed on the aforementioned image-receiving sheet, after which the transferred image may be re-transferred to the desired sheet or body. According to this indirect transferring method, the selectivity of the final sheet can be expanded, and at the same time, when a protective layer is formed in advance on the image-receiving sheet, this protective layer can be disposed over the finally transferred image, thus improving the fastness of image thus transferred. Alternatively, when a security layer such as a hologram layer is formed in advance on the image-receiving sheet, the security of the finally transferred image can be improved. The protective layer is interposed between the substrate of the image-receiving sheet and the image-receiving layer formed on the substrate, and the protective layer is preferably releasable.

As for the means for providing the heat energy to be employed on the occasion of obtaining a tone image expression based on areal gradation by making use of the thermal transfer recording medium of this invention and the aforementioned image-receiving sheet, any conventional means can be utilized. Namely, by controlling the heat energy by making use of these means, a gradation image can be obtained.

This invention will be specifically explained with reference to various Examples and Comparative Examples below wherein "parts" and "%" set forth therein are by weight unless otherwise specified. Further, "molecular weight" denotes weight average molecular weight.

EXAMPLE I-1

An ink composition for a thermal transfer recording layer having the following formulation was prepared.

| <Cyan ink> | |
|---|---|
| Phthalocyanin Blue | 9 parts |
| Epoxy resin (Yuka Shell Epoxy; Epikote 1007) * Softening point: 128° C.; epoxy equivalent: 1750–2200; molecular weight: 2900 | 20 parts |
| Colorless silica fine particles (Nihon Aerogel; Aerogel R972) | 4 parts |
| Methyl ethyl ketone | 67 parts |

-continued

| <Magenta ink> | |
|---|---|
| Carmine 6B | 9 parts |
| Epoxy resin (Yuka Shell Epoxy; Epikote 1007) * Softening point: 128° C.; epoxy equivalent: 1750–2200; molecular weight: 2900 | 20 parts |
| Colorless silica fine particles (Nihon Aerogel; Aerogel R972) | 4 parts |
| Methyl ethyl ketone | 67 parts |

| <Yellow ink> | |
|---|---|
| Disazo Yellow | 9 parts |
| Epoxy resin (Yuka Shell Epoxy; Epikote 1007) * Softening point: 128° C.; epoxy equivalent: 1750–2200; molecular weight: 2900 | 20 parts |
| Colorless silica fine particles (Nihon Aerogel; Aerogel R972) | 4 parts |
| Methyl ethyl ketone | 67 parts |

Figure 3:
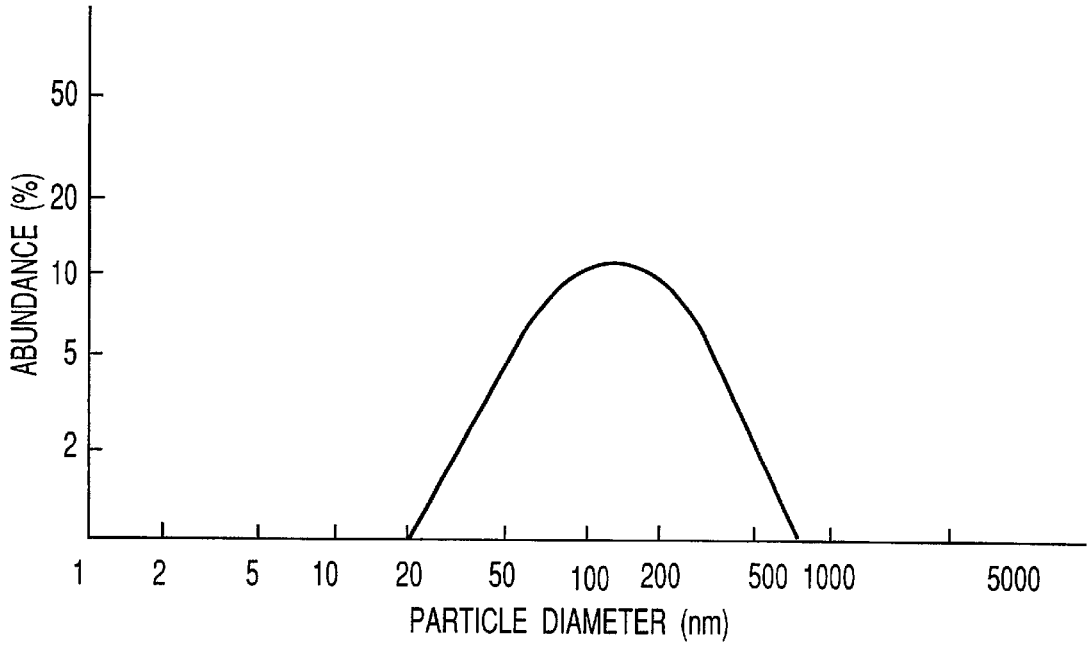
FIG. 3 is a graph showing a particle distribution of a cyan pigment (phthalocyanine Blue) which was employed in an Example described below.
Figure 4:
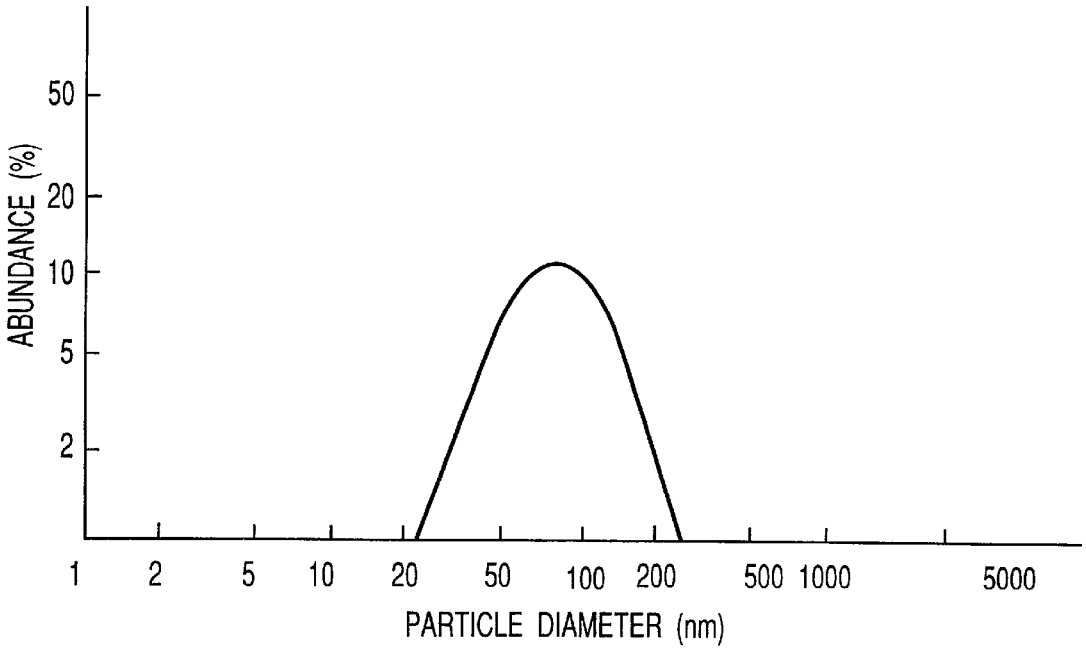
FIG. 4 is a graph showing a particle distribution of a magenta pigment (Carmine 6B) which was employed in an Example described below.
Figure 5:
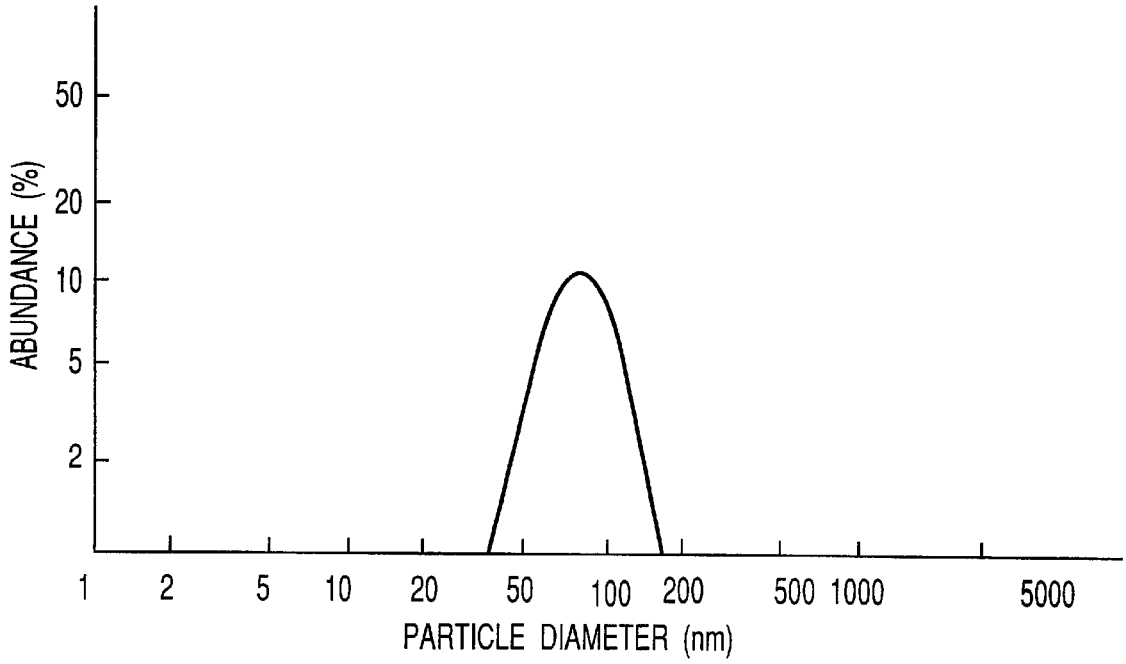
FIG. 5 is a graph showing a particle distribution of a yellow pigment (Disazo Yellow) which was employed in an Example described below.
Figure 6:
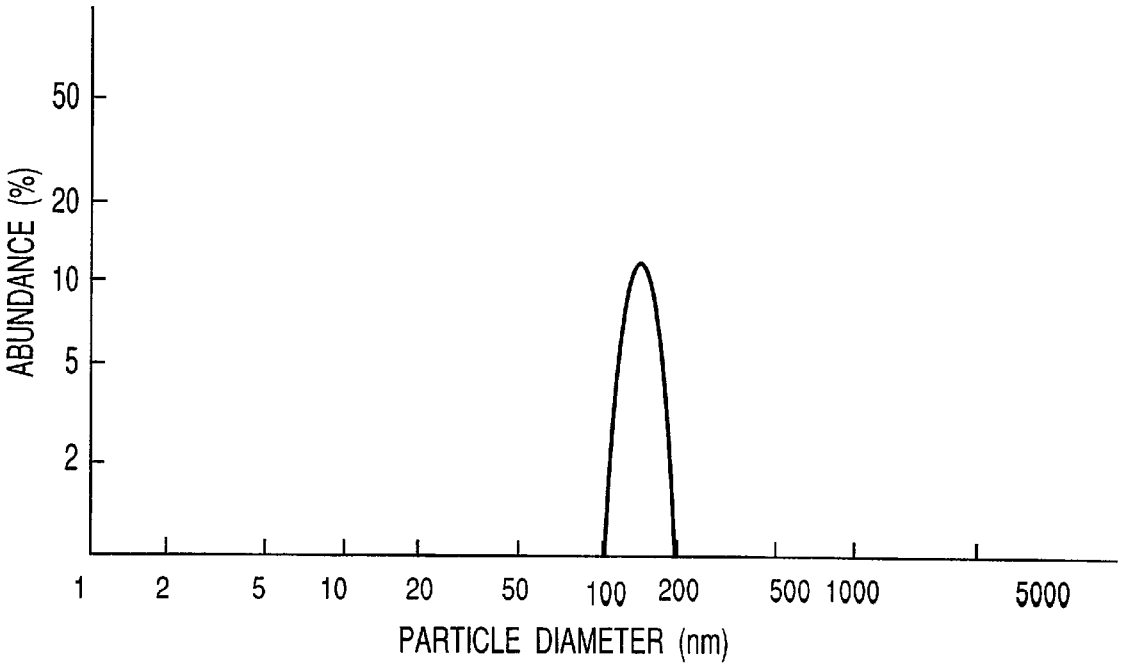
FIG. 6 is a graph showing a particle distribution of colorless silica particles employed in an Example described below.

The particle size distribution of the aforementioned cyan pigment (Phthalocyanin Blue) is shown in FIG. 3, the particle size distribution of the aforementioned Magenta pigment (Carmine 6B) is shown in FIG. 4, the particle size distribution of the aforementioned yellow pigment (Disazo Yellow) is shown in FIG. 5, and the particle size distribution of the aforementioned colorless silica fine particles is shown in FIG. 6.

The inks each having the aforementioned formulation for a thermal transfer recording layer were coated successively on the surface of a polyethylene terephthalate film having a thickness of 5.4 μm, with the reverse surface thereof being subjected to heat resistance treatment, thereby obtaining a coated layer having a thickness of 0.7 μm, which was then dried to obtain a thermal transfer recording medium of this invention, having a structure as shown in FIG. 1.

Then, the following ink for an image-receiving layer was coated on the easy adhesion surface of an easy adhesive polyester film having a thickness of 100 μm to form a film having a thickness of 5 μm (dry thickness), which was dried, thereby obtaining an image-receiving sheet.

| <Ink for image-receiving layer> | |
|---|---|
| Epoxy resin (Yuka Shell Epoxy; Epikote 1007) * Softening point: 128° C.; epoxy equivalent: 1750–2200; molecular weight: 2900 | 30 parts |
| Methyl ethyl ketone | 70 parts |

The image-receiving sheet thus obtained was superimposed on the surface of the cyan region of the thermal transfer recording surface of the thermal transfer recording medium, and then, by making use of a thermal head, a cyan image based on the areal gradation corresponding to the heating element of the thermal head was formed. Then, a magenta image based on the areal gradation was formed on the image-receiving sheet bearing the cyan image by way of the thermal transferring of the magenta region and in the same manner as in the case of cyan. Likewise, a yellow image was formed, thereby forming a full color image based only on the areal gradation on the image-receiving sheet.

COMPARATIVE EXAMPLE I-1

The following sublimation transfer type ink composition for a thermal transfer recording layer was prepared.

| <Cyan ink> | |
|---|---|
| C.I. Solvent Blue 63 | 5 parts |
| Butyral resin (BX-1, Sekisui Chemical Co. Ltd.) | 5 parts |
| Methyl ethyl ketone | 60 parts |
| Toluene | 30 parts |

| <Magenta ink> | |
|---|---|
| C.I. Disperse Red 60 | 5 parts |
| Butyral resin (BX-1, Sekisui Chemical Co. Ltd.) | 5 parts |
| Methyl ethyl ketone | 60 parts |
| Toluene | 30 parts |

| <Yellow ink> | |
|---|---|
| C.I. Disperse Yellow 201 | 5 parts |
| Butyral resin (BX-1, Sekisui Chemical Co. Ltd.) | 5 parts |
| Methyl ethyl ketone | 60 parts |
| Toluene | 30 parts |

The inks each having the aforementioned formulation for a thermal transfer recording layer were coated successively on the surface of a polyethylene terephthalate film having a thickness of 5.4 μm, the reverse surface thereof being subjected to heat resistance treatment, thereby obtaining coated layers each having a thickness of 1.0 μm, which were then dried to obtain a sublimation transfer type thermal transfer recording medium of Comparative Example I-1.

Then, the following ink for a dye-receiving layer was coated on the easy adhesion surface of an easy adhesive polyester film (saturated polyester film; polyethylene terephthalate film) having a thickness of 100 μm to form a film having a thickness of 4 μm (dry thickness), which was dried and then subjected to aging at 45° C. for one week, thereby obtaining an image-receiving sheet.

| <Ink for dye-receiving layer> | |
|---|---|
| Acetal resin | 10 parts |
| Vinyl chloride/vinyl acetate copolymer | 10 parts |
| Silicone oil | 2 parts |
| Isocyanate resin | 3 parts |
| Methyl ethyl ketone | 50 parts |
| Toluene | 25 parts |

The dye-receiving surface of the image-receiving sheet thus obtained was superimposed on the thermal transfer recording surface of the thermal transfer recording medium, and then, by making use of a thermal head, the yellow layer, the magenta layer and the cyan layer were successively printed to obtain a color image according to sublimation transferring.

COMPARATIVE EXAMPLE I-2

A color image was obtained from a thermal transfer recording medium in the same manner as described in Example I-1 except that the thickness of all of the ink layers for the thermal transfer recording layer, i.e. the cyan layer, the Magenta layer and the yellow layer was set to 1.2 μm.

COMPARATIVE EXAMPLE I-3

A color image was obtained from a thermal transfer recording medium in the same manner as described in Example I-1 except that the ink composition for the thermal transfer recording layer was changed to the following formulation.

| <Cyan ink> | |
|---|---|
| Phthalocyanin Blue | 9 parts |
| Epoxy resin (Yuka Shell Epoxy; Epikote 1007) * Softening point: 128° C.; epoxy equivalent: 1750–2200; molecular weight: 2900 | 20 parts |
| Methyl ethyl ketone | 71 parts |
| <Magenta ink> | |
| Carmine 6B | 9 parts |
| Epoxy resin (Yuka Shell Epoxy; Epikote 1007) * Softening point: 128° C.; epoxy equivalent: 1750–2200; molecular weight: 2900 | 20 parts |
| Methyl ethyl ketone | 71 parts |
| <Yellow ink> | |
| Disazo Yellow | 9 parts |
| Epoxy resin (Yuka Shell Epoxy; Epikote 1007) * Softening point: 128° C.; epoxy equivalent: 1750–2200; molecular weight: 2900 | 20 parts |
| Methyl ethyl ketone | 71 parts |

COMPARATIVE EXAMPLE I-4

A color image was obtained from a thermal transfer recording medium in the same manner as described in Example I-1 except that the ink composition for the thermal transfer recording layer was changed to the following formulation.

| <Cyan ink> | |
|---|---|
| Phthalocyanin Blue | 9 parts |
| Epoxy resin (Yuka Shell Epoxy; Epikote 1001) * Softening point: 64° C.; epoxy equivalent: 450–500; molecular weight: 900 | 20 parts |
| Colorless silica fine particles (Nihon Aerogel; Aerogel R972) | 4 parts |
| Methyl ethyl ketone | 67 parts |
| <Magenta ink> | |
| Carmine 6B | 9 parts |
| Epoxy resin (Yuka Shell Epoxy; Epikote 1001) * Softening point: 64° C.; epoxy equivalent: 450–500; molecular weight: 900 | 20 parts |
| Colorless silica fine particles (Nihon Aerogel; Aerogel R972) | 4 parts |
| Methyl ethyl ketone | 67 parts |
| <Yellow ink> | |
| Disazo Yellow | 9 parts |
| Epoxy resin (Yuka Shell Epoxy; Epikote 1001) * Softening point: 64° C.; epoxy equivalent: 450–500; molecular weight: 900 | 20 parts |
| Colorless silica fine particles (Nihon Aerogel; Aerogel R972) | 4 parts |
| Methyl ethyl ketone | 67 parts |

COMPARATIVE EXAMPLE I-5

A color image was obtained from a thermal transfer recording medium in the same manner as described in Example I-1 except that the ink composition for the thermal transfer recording layer was changed to the following formulation.

| <Cyan ink> | |
|---|---|
| Phthalocyanin Blue | 9 parts |
| Epoxy resin (Yuka Shell Epoxy; Epikote 1010) * Softening point: 169° C.; epoxy equivalent: 3000–5000; molecular weight: 5500 | 20 parts |
| Colorless silica fine particles (Nihon Aerogel; Aerogel R972) | 4 parts |
| Methyl ethyl ketone | 67 parts |
| <Magenta ink> | |
| Carmine 6B | 9 parts |
| Epoxy resin (Yuka Shell Epoxy; Epikote 1010) * Softening point: 169° C.; epoxy equivalent: 3000–5000; molecular weight: 5500 | 20 parts |
| Colorless silica fine particles (Nihon Aerogel; Aerogel R972) | 4 parts |
| Methyl ethyl ketone | 67 parts |
| <Yellow ink> | |
| Disazo Yellow | 9 parts |
| Epoxy resin (Yuka Shell Epoxy; Epikote 1010) * Softening point: 169° C.; epoxy equivalent: 3000–5000; molecular weight: 5500 | 20 parts |
| Colorless silica fine particles (Nihon Aerogel; Aerogel R972) | 4 parts |
| Methyl ethyl ketone | 67 parts |

COMPARATIVE EXAMPLE I-6

A color image was obtained from a thermal transfer recording medium in the same manner as described in Example I-1 except that the ink composition for the thermal transfer recording layer was changed to the following formulation.

| <Cyan ink> | |
|---|---|
| Phthalocyanin Blue | 4 parts |
| Epoxy resin (Yuka Shell Epoxy; Epikote 1007) * Softening point: 128° C.; epoxy equivalent: 1750–2200; molecular weight: 2900 | 20 parts |
| Colorless silica fine particles (Nihon Aerogel; Aerogel R972) | 4 parts |
| Methyl ethyl ketone | 72 parts |
| <Magenta ink> | |
| Carmine 6B | 4 parts |
| Epoxy resin (Yuka Shell Epoxy; Epikote 1007) * Softening point: 128° C.; epoxy equivalent: 1750–2200; molecular weight: 2900 | 20 parts |
| Colorless silica fine particles (Nihon Aerogel; Aerogel R972) | 4 parts |
| Methyl ethyl ketone | 72 parts |
| <Yellow ink> | |
| Disazo Yellow | 4 parts |
| Epoxy resin (Yuka Shell Epoxy; Epikote 1007) * Softening point: 128° C.; epoxy equivalent: 1750–2200; molecular weiqht: 2900 | 20 parts |

-continued

| | |
|---|---|
| Colorless silica fine particles (Nihon Aerogel; Aerogel R972) | 4 parts |
| Methyl ethyl ketone | 72 parts |

COMPARATIVE EXAMPLE I-7

A color image was obtained from a thermal transfer recording medium in the same manner as described in Example I-1 except that the ink composition for the thermal transfer recording layer was changed to the following formulation.

| <Cyan ink> | |
|---|---|
| Phthalocyanin Blue | 15 parts |
| Epoxy resin (Yuka Shell Epoxy; Epikote 1007) * Softening point: 128° C.; epoxy equivalent: 1750–2200; molecular weight: 2900 | 20 parts |
| Colorless silica fine particles (Nihon Aerogel; Aerogel R972) | 4 parts |
| Methyl ethyl ketone | 61 parts |
| <Magenta ink> | |
| Carmine 6B | 15 parts |
| Epoxy resin (Yuka Shell Epoxy; Epikote 1007) * Softening point: 128° C.; epoxy equivalent: 1750–2200; molecular weight: 2900 | 20 parts |
| Colorless silica fine particles (Nihon Aerogel; Aerogel R972) | 4 parts |
| Methyl ethyl ketone | 61 parts |
| <Yellow ink> | |
| Disazo Yellow | 15 parts |
| Epoxy resin (Yuka Shell Epoxy; Epikote 1007) * Softening point: 128° C.; epoxy equivalent: 1750–2200; molecular weight: 2900 | 20 parts |
| Colorless silica fine particles (Nihon Aerogel; Aerogel R972) | 4 parts |
| Methyl ethyl ketone | 61 parts |

The images obtained in Example I-1, Comparative Examples I-1 to I-7 were evaluated on the image tone reproduction, image concentration, light resistance and fixability thereof. The results are shown in the following Table 1.

EXAMPLE I-2

The same procedures as described in Example I-1 were repeated except that the following black ink composition was included in the ink composition for the thermal transfer recording layer in addition to the compositions of the three colors, i.e. cyan, red and yellow, thereby producing a thermal transfer recording medium shown in FIG. 2. Then, by making use of this recording medium, a color image based on an additive color mixture of four colors or a color image consisting of four primary colors was obtained.

| <Black ink> | |
|---|---|
| Carbon black | 9 parts |
| Epoxy resin (Yuka Shell Epoxy; Epikote 1007) * Softening point: 128° C.; epoxy equivalent: 1750–2200; molecular weight: 2900 | 20 parts |

-continued

| <Black ink> | |
|---|---|
| Colorless fine particles (silica; Nihon Aerogel; Aerogel R972) | 4 parts |
| Methyl ethyl ketone | 67 parts |

The image obtained in this example was found almost the same in features as that obtained in Example I-1.

EXAMPLE I-3

The same procedures as described in Example I-1 were repeated except that the following black ink composition was included in the ink composition for the thermal transfer recording layer in addition to the compositions of the three colors, i.e. cyan, red and yellow, thereby producing a thermal transfer recording medium shown in FIG. 2. Then, by making use of this recording medium, a color image based on an additive color mixture of four colors or a color image consisting of four primary colors was obtained.

EXAMPLE I-4

By making use of the thermal transfer recording medium obtained in Example I-1, an image was reproduced on an image-receiving sheet having a formulation as described below.

<Construction of the Image-receiving Sheet>

Each of the ink formulations was successively coated on a polyester film having a thickness of 25 μm, and dried to obtain an image-receiving sheet bearing thereon a laminated structure consisting of a releasing layer and an image-receiving layer, which layers are repeatedly laminated.

| <Ink for the releasing layer> | |
|---|---|
| Acrylic resin | 20 parts |
| Methyl ethyl ketone | 40 parts |
| Toluene | 40 parts |
| <Ink for image-receiving layer> | |
| Epoxy resin (Yuka Shell Epoxy; Epikote 1007) * Softening point: 128° C.; epoxy equivalent 1750–2200; molecular weight: 2900 | 30 parts |
| Methyl ethyl ketone | 70 parts |

After the image-receiving sheet bearing an image was superimposed on an end product sheet, a heat roller was applied from the reverse side of the image-receiving sheet to perform a thermal transferring of the image on the sheet. Subsequently, when only the polyester film was peeled off, it was possible to obtain an excellent transferred image which was covered with a releasing layer functioning also as a protective layer.

EXAMPLE I-5

By making use of the thermal transfer recording medium obtained in Example I-1, an image was reproduced on an image-receiving sheet having a formulation as described below.

<Construction of the Image-receiving Sheet>

An ink for a releasing layer and an ink for a hologram-forming layer were successively coated on a polyester film having a thickness of 25 μm, and dried to obtain a releasing layer and a hologram-forming layer. Then, a heat embossing press was employed to form a projected and recessed pattern constituting a hologram on the surface of the hologram-forming layer.

| <Ink for the releasing layer> | |
|---|---|
| Acrylic resin | 20 parts |
| Methyl ethyl ketone | 40 parts |
| Toluene | 40 parts |
| <Ink for the hologram-forming layer> | |
| Vinyl chloride-vinyl acetate copolymer | 20 parts |
| Urethane resin | 15 parts |
| Methyl ethyl ketone | 70 parts |
| Toluene | 30 parts |

After ZnS was deposited to form a transparent thin film on the surface of hologram-forming layer, an ink for the image-forming layer having the following composition was coated and dried to form an image-receiving layer, thus obtaining an image-receiving sheet.

| <Ink for image-receiving layer> | |
|---|---|
| Epoxy resin (Yuka Shell Epoxy; Epikote 1007) * Softening point: 128° C.; epoxy equivalent: 1750–2200; molecular weight: 2900 | 20 parts |
| Urethane resin | 10 parts |
| Methyl ethyl ketone | 70 parts |

After the image-receiving sheet bearing an image was superimposed on an end product sheet having an ultraviolet fluorescent agent-printed surface, a heat roller was applied from the reverse side of the image-receiving sheet to perform a thermal transferring of the image. Subsequently, when only the polyester film was peeled off, it was possible to obtain an excellent transferred image which was covered with a releasing layer functioning also as a protective layer.

Since the transferred image thus obtained was accompanied with a hologram image functioning as a security, the transferred image was useful for enhancing security.

The images obtained in Examples I-2 to I-5 were evaluated on the image tone reproduction, image concentration, light resistance and fixability thereof. The results are also shown in the following Table 1.

TABLE 1

| Physical Properties | | Gradation reproduction | Image density | Light resistance | Fixability |
|---|---|---|---|---|---|
| Invention | I-1 | ○ | ○ | ○ | ○ |
| | I-2 | ○ | ○ | ○ | ○ |
| | I-3 | ○ | ○ | ○ | ○ |
| | I-4 | ○ | ○ | ○ | ○ |
| | I-5 | ○ | ○ | ○ | ○ |
| Comparative example | I-1 | ○ | ○ | X | ○ |
| | I-2 | X | ○ | ○ | ○ |
| | I-3 | X | ○ | ○ | ○ |
| | I-4 | ○ | ○ | ○ | X |
| | I-5 | X | ○ | ○ | ○ |
| | I-6 | X | X | ○ | ○ |
| | I-7 | ○ | ○ | ○ | X |

(Note)

Image tone reproduction:

○: The color image reproduced is excellent in fidelity throughout entire regions including the highlight portion and the shadow portion.

X: The color image reproduced is insufficient in fidelity throughout entire regions including the highlight portion and the shadow portion.

Concentration of image:

○: The reflection density of color is 1.4 or more.

X: The reflection density of color is less than 1.4.

Light resistance: The surface of color image is subjected to light irradiation for 80 hours, and the fading ratio was measured by making use of a xenon fade meter.

○: The fading ratio was less than 5%.

X: The fading ratio was not less than 5%.

Fixability: The magnitude of tailing of image portion when the surface of color image was rubbed by the ordinary force using one's nail.

○: No tailing.

X: The periphery of the image portion was stained.

As shown in the above Table 1, the thermal recording mediums according to this invention were effective in obtaining a color image which was excellent in tone reproduction, thereby enabling faithful reproduction of an image with high concentration throughout entire regions including the highlight portion and the shadow portion. Additionally, it was found possible to obtain a thermal transfer recording medium which was excellent in durability of image printed.

EXAMPLE II-1

An ink composition for a thermal transfer recording layer having the following composition was prepared.

| <Cyan ink> | |
|---|---|
| Phthalocyanin Blue | 9 parts |
| Acrylic resin (Mitsubishi Rayon Co., Ltd.; BR113) * Tg: 75° C.; molecular weight: 30000. | 20 parts |
| Colorless silica fine particles (Nihon Aerogel; Aerogel R972) | 5 parts |
| Methyl ethyl ketone | 67 parts |
| <Magenta ink> | |
| Carmine 6B | 9 parts |
| Acrylic resin (Mitsubishi Rayon Co., Ltd.; BR113) * Tg: 75° C.; molecular weight: 30000. | 20 parts |
| Colorless silica fine particles (Nihon Aerogel; Aerogel R972) | 5 parts |
| Methyl ethyl ketone | 67 parts |
| <Yellow ink> | |
| Disazo Yellow | 9 parts |
| Acrylic resin (Mitsubishi Rayon Co., Ltd.; BR113) * Tg: 75° C.; molecular weight: 30000. | 20 parts |
| Colorless silica fine particles (Nihon Aerogel; Aerogel R972) | 4 parts |
| Methyl ethyl ketone | 67 parts |

The inks each having the aforementioned formulation for a thermal transfer recording layer were coated successively on the surface of a polyethylene terephthalate film having a thickness of 5.4 μm, the reverse surface thereof being subjected to heat resistance treatment, thereby obtaining coated layers each having a thickness of 0.7 μm, which were then dried to obtain a thermal transfer recording medium of this invention, the structure of which is shown in FIG. 1.

Then, the following ink for an image-receiving layer was coated on the easy adhesion surface of an easy adhesive polyester film having a thickness of 100 μm to form a film having a thickness of 5 μm (dry thickness), which was dried, thereby obtaining an image-receiving sheet.

| <Ink for image-receiving layer> | |
|---|---|
| Acrylic resin<br>(Mitsubishi Rayon Co., Ltd.; BR113)<br>* Tg: 75° C.; molecular weight: 30000. | 20 parts |
| Methyl ethyl ketone | 70 parts |

The image-receiving sheet thus obtained was superimposed on the surface of the cyan region of the thermal transfer recording: surface of the thermal transfer recording medium, and then, by making use of a thermal head, a cyan image based on the areal gradation corresponding to the heating element of the thermal head was formed. Then, a Magenta image based on the areal gradation was formed on the image-receiving sheet bearing the cyan image by way of the thermal transferring of the Magenta region and in the same manner as in the case of cyan. Likewise, a yellow image was formed, thereby forming a full color image based only on the areal gradation on the image-receiving sheet.

COMPARATIVE EXAMPLE II-1

A color image was obtained from a thermal transfer recording medium in the same manner as described in Example II-1 except that the thickness of all of the ink layers for the thermal transfer recording layer, i.e., the cyan layer, the Magenta layer and the yellow layer, was set to 1.2 μm.

COMPARATIVE EXAMPLE II-2

A color image was obtained from a thermal transfer recording medium in the same manner as described in Example II-1 except that the ink composition for the thermal transfer recording layer was changed to the following formulation.

<Cyan Ink>

| | |
|---|---|
| Phthalocyanin Blue | 9 parts |
| Acrylic resin<br>(Mitsubishi Rayon Co., Ltd.; BR113)<br>* Tg: 75° C.; molecular weight: 30000. | 20 parts |
| Methyl ethyl ketone | 71 parts |

<Magenta Ink>

| | |
|---|---|
| Carmine 6B | 9 parts |
| Acrylic resin<br>(Mitsubishi Rayon Co., Ltd.; BR113)<br>* Tg: 75° C.; molecular weight: 30000. | 20 parts |
| Methyl ethyl ketone | 71 parts |

<Yellow Ink>

| | |
|---|---|
| Disazo Yellow | 9 parts |
| Acrylic resin<br>(Mitsubishi Rayon Co., Ltd.; BR113)<br>* Tg: 75° C.; molecular weight: 30000. | 20 parts |
| Methyl ethyl ketone | 71 parts |

COMPARATIVE EXAMPLE II-3

A color image was obtained from a thermal transfer recording medium in the same manner as described in Example II-1 except that the ink composition for the thermal transfer recording layer was changed to the following formulation.

<Cyan Ink>

| | |
|---|---|
| Phthalocyanin Blue | 9 parts |
| Acrylic resin<br>(Mitsubishi Rayon Co., Ltd.; BR112)<br>* Tg: 20° C.; molecular weight: 180000. | 20 parts |
| Colorless silica fine particles<br>(Nihon Aerogel; Aerogel R972) | 4 parts |
| Methyl ethyl ketone | 67 parts |

<Magenta Ink>

| | |
|---|---|
| Carmine 6B | 9 parts |
| Acrylic resin<br>(Mitsubishi Rayon Co., Ltd.; BR112)<br>* Tg: 20° C.; molecular weight: 180000. | 20 parts |
| Colorless silica fine particles<br>(Nihon Aerogel; Aerogel R972) | 4 parts |
| Methyl ethyl ketone | 67 parts |

<Yellow Ink>

| | |
|---|---|
| Disazo Yellow | 9 parts |
| Acrylic resin<br>(Mitsubishi Rayon Co., Ltd.; BR112)<br>* Tg: 20° C.; molecular weight: 180000. | 20 parts |
| Colorless silica fine particles<br>(Nihon Aerogel; Aerogel R972) | 4 parts |
| Methyl ethyl ketone | 67 parts |

COMPARATIVE EXAMPLE II-4

A color image was obtained from a thermal transfer recording medium in the same manner as described in Example II-1 except that the ink composition for the thermal transfer recording layer was changed to the following formulation.

<Cyan Ink>

| | |
|---|---|
| Phthalocyanin Blue | 9 parts |
| Acrylic resin<br>(Mitsubishi Rayon Co., Ltd.; BR60)<br>* Tg: 75° C.; molecular weight: 70000. | 20 parts |
| Colorless silica fine particles<br>(Nihon Aerogel; Aerogel R972) | 4 parts |
| Methyl ethyl ketone | 67 parts |

<Magenta Ink>

| | |
|---|---|
| Carmine 6B | 9 parts |
| Acrylic resin<br>(Mitsubishi Rayon Co., Ltd.; BR60)<br>* Tg: 75° C.; molecular weight: 70000. | 20 parts |
| Colorless silica fine particles<br>(Nihon Aerogel; Aerogel R972) | 4 parts |
| Methyl ethyl ketone | 67 parts |

<Yellow Ink>

| | |
|---|---|
| Disazo Yellow | 9 parts |
| Acrylic resin | 20 parts |
| (Mitsubishi Rayon Co., Ltd.; BR60) | |
| * Tg: 75° C.; molecular weight: 70000. | |
| Colorless silica fine particles | 4 parts |
| (Nihon Aerogel; Aerogel R972) | |
| Methyl ethyl ketone | 67 parts |

COMPARATIVE EXAMPLE II-5

A color image was obtained from a thermal transfer recording medium in the same manner as described in Example II-1 except that the ink composition for the thermal transfer recording layer was changed to the following formulation.

<Cyan Ink>

| | |
|---|---|
| Phthalocyanin Blue | 4 parts |
| Acrylic resin | 20 parts |
| (Mitsubishi Rayon Co., Ltd.; BR113) | |
| * Tg: 75° C.; molecular weight: 30000. | |
| Colorless silica fine particles | 4 parts |
| (Nihon Aerogel; Aerogel R972) | |
| Methyl ethyl ketone | 72 parts |

<Magenta Ink>

| | |
|---|---|
| Carmine 6B | 4 parts |
| Acrylic resin | 20 parts |
| (Mitsubishi Rayon Co., Ltd.; BR113) | |
| * Tg: 75° C.; molecular weight: 30000. | |
| Colorless silica fine particles | 4 parts |
| (Nihon Aerogel; Aerogel R972) | |
| Methyl ethyl ketone | 72 parts |

<Yellow Ink>

| | |
|---|---|
| Disazo Yellow | 4 parts |
| Acrylic resin | 20 parts |
| (Mitsubishi Rayon Co., Ltd.; BR113) | |
| * Tg: 75° C.; molecular weight: 30000. | |
| Colorless silica fine particles | 4 parts |
| (Nihon Aerogel; Aerogel R972) | |
| Methyl ethyl ketone | 72 parts |

COMPARATIVE EXAMPLE II-6

A color image was obtained from a thermal transfer recording medium in the same manner as described in Example II-1 except that the ink composition for the thermal transfer recording layer was changed to the following formulation.

<Cyan Ink>

| | |
|---|---|
| Phthalocyanin Blue | 15 parts |
| Acrylic resin | 20 parts |
| (Mitsubishi Rayon Co., Ltd.; BR113) | |
| * Tg: 75° C.; molecular weight: 30000. | |

-continued

| | |
|---|---|
| Colorless silica fine particles | 4 parts |
| (Nihon Aerogel; Aerogel R972) | |
| Methyl ethyl ketone | 61 parts |

<Magenta Ink>

| | |
|---|---|
| Carmine 6B | 15 parts |
| Acrylic resin | 20 parts |
| (Mitsubishi Rayon Co., Ltd.; BR113) | |
| * Tg: 75° C.; molecular weight: 30000. | |
| Colorless silica fine particles | 4 parts |
| (Nihon Aerogel; Aerogel R972) | |
| Methyl ethyl ketone | 61 parts |

<Yellow Ink>

| | |
|---|---|
| Disazo Yellow | 15 parts |
| Acrylic resin | 20 parts |
| (Mitsubishi Rayon Co., Ltd.; BR113) | |
| * Tg: 75° C.; molecular weight: 30000. | |
| Colorless silica fine particles | 4 parts |
| (Nihon Aerogel; Aerogel R972) | |
| Methyl ethyl ketone | 61 parts |

The images obtained in Example II-1, and Comparative Examples II-1 to II-6, were evaluated on the image tone reproduction, image concentration, light resistance and fixability thereof. The results are shown in the following Table 2.

EXAMPLE II-2

The same procedures as described in Example I-1 were repeated except that the following black ink composition was included in the ink composition for the thermal transfer recording layer in addition to the compositions of three colors, i.e. cyan, red and yellow, thereby producing a thermal transfer recording medium shown in FIG. 2. Then, by making use of this recording medium, a color image consisting of four primary colors was obtained.

<Black Ink>

| | |
|---|---|
| Carbon black | 9 parts |
| Acrylic resin | 20 parts |
| (Mitsubishi Rayon Co., Ltd.; BR113) | |
| * Tg: 75° C.; molecular weight: 30000. | |
| Colorless fine particles (silica; | 4 parts |
| Nihon Aerogel; Aerogel R972) | |
| Methyl ethyl ketone | 67 parts |

The image obtained in this example was found to be almost the same in features as that obtained in Example II-1.

EXAMPLE II-3

In the same manner as described in Example II-1, a color image was produced using a color mixture formed of three colors, i.e. cyan, Magenta and yellow, and at the same time, a binary image such as letters and bar codes was produced using the black ink. As a result, the images thus obtained were found to have excellent various properties as described in Example I-1, and the letters as well as the bar codes were also excellent in fastness.

EXAMPLE II-4

By making use of the thermal transfer recording medium obtained in Example I-1, an image was reproduced on an image-receiving sheet having a formulation as described below.

<Construction of the Image-receiving Sheet>

Each of the ink formulations was successively coated on a polyester film having a thickness of 25 μm, and dried to obtain an image-receiving sheet bearing thereon a laminated structure consisting of a releasing layer and an image-receiving layer, which layers are repeatedly laminated.

<Ink for the Releasing Layer>

| | |
|---|---|
| Acrylic resin | 20 parts |
| Methyl ethyl ketone | 40 parts |
| Toluene | 40 parts |
| <Ink for image-receiving layer> | |
| Acrylic resin | 20 parts |
| (Mitsubishi Rayon Co., Ltd.; BR116) | |
| * Tg: 50° C.; molecular weight: 45000. | |
| Methyl ethyl ketone | 70 parts |

After the image-receiving sheet bearing an image was superimposed on an end product sheet, a heat roller was applied from the reverse side of the image-receiving sheet to perform a thermal transferring of the image on the sheet. Subsequently, when only the polyethylene terephthalate film was peeled off, it was possible to obtain an excellent transferred image which was covered with a releasing layer functioning also as a protective layer.

EXAMPLE II-5

By making use of the thermal transfer recording medium obtained in Example II-1, an image was reproduced on an image-receiving sheet having a formulation as described below.

<Construction of the Image-receiving Sheet>

An ink for a releasing layer and an ink for a hologram-forming layer were successively coated on a polyester film having a thickness of 25 μm, and dried to obtain a releasing layer and a hologram-forming layer. Then, a heat embossing press was employed to form a projected and recessed pattern constituting a hologram on the surface of the hologram-forming layer.

<Ink for the Releasing Layer>

| | |
|---|---|
| Acrylic resin | 20 parts |
| Methyl ethyl ketone | 40 parts |
| Toluene | 40 parts |

<Ink for the Hologram-forming Layer>

| | |
|---|---|
| Vinyl chloride-vinyl acetate copolymer | 20 parts |
| Urethane resin | 15 parts |
| Methyl ethyl ketone | 70 parts |
| Toluene | 30 parts |

After ZnS was deposited to form a transparent thin film on the surface of the hologram-forming layer, an ink for an image-forming layer having the following composition was coated and dried to form an image-receiving layer, thus obtaining an image-receiving sheet.

<Ink for Image-receiving Layer>

| | |
|---|---|
| Acrylic resin | 20 parts |
| (Mitsubishi Rayon Co., Ltd.; BR116) | |
| * Tg: 50° C.; molecular weight: 45000. | |
| Urethane resin | 10 parts |
| Methyl ethyl ketone | 70 parts |

After the image-receiving sheet bearing an image was superimposed on an end product sheet having an ultraviolet fluorescent agent-printed surface, a heat roller was applied from the reverse side of the image-receiving sheet to perform a thermal transferring of the image. Subsequently, when only the polyester film was peeled off, it was possible to obtain an excellent transferred image which was covered with a releasing layer functioning also as a protective layer.

Since the transferred image thus obtained was accompanied with a hologram image functioning as a security, the transferred image was useful for enhancing security.

The images obtained in Examples II-2 to II-5 were evaluated on the image tone reproduction, image concentration, light resistance and fixability thereof. The results are also shown in the following Table 2.

TABLE 2

| Physical properties | | Gradation reproduction | Image density | Light resistance | Fixability |
|---|---|---|---|---|---|
| Invention | II-1 | ○ | ○ | ○ | ○ |
| | II-2 | ○ | ○ | ○ | ○ |
| | II-3 | ○ | ○ | ○ | ○ |
| | II-4 | ○ | ○ | ○ | ○ |
| | II-5 | ○ | ○ | ○ | ○ |
| Comparative example | II-1 | X | ○ | X | ○ |
| | II-2 | X | ○ | ○ | ○ |
| | II-3 | X | ○ | ○ | X |
| | II-4 | X | ○ | ○ | ○ |
| | II-5 | X | X | ○ | ○ |
| | II-6 | ○ | ○ | ○ | X |

EXAMPLE III-1

An ink composition for thermal transfer recording layer having the following composition was prepared.

<Cyan Ink>

| | |
|---|---|
| Phthalocyanin Blue | 9 parts |
| Vinyl chloride/vinyl acetate copolymer | 20 parts |
| (Union Carbide Co., Ltd.; VROH) | |
| * Molecular weight: 15000 | |
| Colorless silica fine particles | 5 parts |
| (Nihon Aerogel; Aerogel R972) | |
| Methyl ethyl ketone | 67 parts |

<Magenta Ink>

| | |
|---|---|
| Carmine 6B | 9 parts |
| Vinyl chloride/vinyl acetate copolymer | 20 parts |
| (Union Carbide Co., Ltd.; VROH) | |
| * Molecular weight: 15000 | |
| Colorless silica fine particles | 5 parts |
| (Nihon Aerogel; Aerogel R972) | |
| Methyl ethyl ketone | 67 parts |

<Yellow Ink>

| | |
|---|---|
| Disazo Yellow | 9 parts |
| Vinyl chloride/vinyl acetate copolymer (Union Carbide Co., Ltd.; VROH) * Molecular weight: 15000 | 20 parts |
| Colorless silica fine particles (Nihon Aerogel; Aerogel R972) | 4 parts |
| Methyl ethyl ketone | 67 parts |

The inks each having the aforementioned formulation for a thermal transfer recording layer were coated successively on the surface of a polyethylene terephthalate film having a thickness of 5.4 μm, the reverse surface thereof being subjected to heat resistance treatment, thereby obtaining coated layers each having a thickness of 0.7 μm, which were then dried to obtain a thermal transfer recording medium of this invention, the structure of which is shown in FIG. 1.

Then, the following ink for an image-receiving layer was coated on the easy adhesion surface of an easy adhesive polyester film (saturated polyester film; polyethylene terephthalate film) having a thickness of 100 μm to form a film having a thickness of 5 μm (dry thickness), which was dried, thereby obtaining an image-receiving sheet.

<Ink for Image-receiving Layer>

| | |
|---|---|
| Vinyl chloride/vinyl acetate copolymer (Union Carbide Co., Ltd.; VMCC) * Molecular weight: 19000 | 20 parts |
| Methyl ethyl ketone | 70 parts |

The image-receiving sheet thus obtained was superimposed on the surface of cyan region of the thermal transfer recording surface of the thermal transfer recording medium, and then, by making use of a thermal head, a cyan image based on the areal gradation corresponding to the heating element of the thermal head was formed. Then, a Magenta image based on the areal gradation was formed on the image-receiving sheet bearing the cyan image by way of the thermal transferring of the Magenta region and in the same manner as in the case of cyan. Likewise, a yellow image was formed, thereby forming a full color image based only on the areal gradation on the image-receiving sheet.

EXAMPLE III-2

A color image was obtained from a thermal transfer recording medium in the same manner as described in Example III-1 except that the ink composition for the thermal transfer recording layer was changed to the following formulation.

<Cyan Ink>

| | |
|---|---|
| Phthalocyanin Blue | 9 parts |
| Vinyl chloride/vinyl acetate copolymer (Union Carbide Co., Ltd.; VMCC) * Molecular weight: 19000 | 20 parts |
| Colorless silica fine particles (Nihon Aerogel; Aerogel R972) | 5 parts |
| Methyl ethyl ketone | 67 parts |

<Magenta Ink>

| | |
|---|---|
| Carmine 6B | 9 parts |
| Vinyl chloride/vinyl acetate copolymer (Union Carbide Co., Ltd.; VMCC) * Molecular weight: 19000 | 20 parts |
| Colorless silica fine particles (Nihon Aerogel; Aerogel R972) | 5 parts |
| Methyl ethyl ketone | 67 parts |

<Yellow Ink>

| | |
|---|---|
| Disazo Yellow | 9 parts |
| Vinyl chloride/vinyl acetate copolymer (Union Carbide Co., Ltd.; VMCC) * Molecular weight: 19000 | 20 parts |
| Colorless silica fine particles (Nihon Aerogel; Aerogel R972) | 5 parts |
| Methyl ethyl ketone | 67 parts |

The image obtained in Example III-2 was found as exhibiting almost the same image-forming property as that of Example III-1, and also found particularly excellent in an alcohol resistance test (water/ethanol=1/1; dipping for 12 hours).

The same procedures as described in Example III-1 were repeated except that the following black ink composition was included in the ink composition for the thermal transfer recording layer in addition to the compositions of three colors, i.e. cyan, red and yellow, thereby producing a thermal transfer recording medium shown in FIG. 2. Then, by making use of this recording medium, a color image consisting of four primary colors was obtained.

<Black Ink>

| | |
|---|---|
| Carbon black | 9 parts |
| Vinyl chloride/vinyl acetate copolymer (Union Carbide Co., Ltd.; VROH) * Molecular weight: 150000 | 20 parts |
| Colorless fine particles (silica; Nihon Aerogel; Aerogel R972) | 4 parts |
| Methyl ethyl ketone | 67 parts |

EXAMPLE III-4

In the same manner as described in Example III-3, a color image was produced using a color mixture formed of three colors, i.e. cyan, Magenta and yellow, and at the same time, a binary image such as letters and bar codes was produced using the black ink.

EXAMPLE III-5

By making use of the thermal transfer recording medium obtained in Example III-1, an image was reproduced on an image-receiving sheet having a formulation as described below.

<Construction of the Image-receiving Sheet>

Each of the ink formulations was successively coated on a polyester film having a thickness of 25 μm, and dried to obtain an image-receiving sheet bearing thereon a laminated structure consisting of a releasing layer and an image-receiving layer, which layers are repeatedly laminated.

<Ink for the Releasing layer>

| | |
|---|---|
| Acrylic resin | 20 parts |
| Methyl ethyl ketone | 40 parts |
| Toluene | 40 parts |

<Ink for Image-receiving Layer>

| | |
|---|---|
| Vinyl chloride/vinyl acetate copolymer (Union Carbide Co., Ltd.; VMCC) * Molecular weight: 19000 | 20 parts |
| Methyl ethyl ketone | 70 parts |

After the image-receiving sheet having an image formed in Example III-5 was superimposed on an end product sheet, a heat roller was applied from the reverse side of the image-receiving sheet to perform a thermal transferring of the image on the sheet. Subsequently, when only the polyester film (polyethylene terephthalate film) was peeled off, it was possible to obtain an excellent transferred image which was covered with a releasing layer functioning also as a protective layer.

EXAMPLE III-6

By making use of the thermal transfer recording medium obtained in Example II-1, an image was reproduced on an image-receiving sheet having a formulation as described below.

<Construction of the Image-receiving Sheet>

An ink for releasing a layer and an ink for a hologram-forming layer were successively coated on a polyester film having a thickness of 25 $\mu$m, and dried to obtain a releasing layer and a hologram-forming layer. Then, a heat embossing press was employed to form a projected and recessed pattern constituting a hologram on the surface of the hologram-forming layer.

<Ink for the Releasing Layer>

| | |
|---|---|
| Acrylic resin | 20 parts |
| Methyl ethyl ketone | 40 parts |
| Toluene | 40 parts |

<Ink for the Hologram-forming Layer>

| | |
|---|---|
| Vinyl chloride-vinyl acetate copolymer | 20 parts |
| Urethane resin | 15 parts |
| Methyl ethyl ketone | 70 parts |
| Toluene | 30 parts |

After ZnS was deposited to form a transparent thin film on the surface of the hologram-forming layer, an ink for an image-forming layer having the following composition was coated and dried to form an image-receiving layer, thus obtaining an image-receiving sheet.

<Ink for Image-receiving Layer>

| | |
|---|---|
| Vinyl chloride/vinyl acetate copolymer (Union Carbide Co., Ltd.; VMCC) * Molecular weight: 19000 | 20 parts |

-continued

| | |
|---|---|
| Urethane resin | 10 parts |
| Methyl ethyl ketone | 70 parts |

After the image-receiving sheet having an image formed in Example III-6 was superimposed on an end product sheet having an ultraviolet fluorescent agent-printed surface, a heat roller was applied from the reverse side of the image-receiving sheet to perform a thermal transferring of the image. Subsequently, when only the polyester film was peeled off, it was possible to obtain an excellent transferred image which was covered with a releasing layer functioning also as a protective layer.

Since the transferred image thus obtained was accompanied with a hologram image functioning as a security, the transferred image was useful for enhancing security.

COMPARATIVE EXAMPLE III-1

A color image was obtained from a thermal transfer recording medium in the same manner as described in Example III-1 except that the thickness of all of the ink layers for the thermal transfer recording layer, i.e., the cyan layer, the Magenta layer and the yellow layer, was set to 1.2 $\mu$m.

COMPARATIVE EXAMPLE III-2

A color image was obtained from a thermal transfer recording medium in the same manner as described in Example III-1 except that the ink composition for the thermal transfer recording layer was changed to the following formulation.

<Cyan Ink>

| | |
|---|---|
| Phthalocyanin Blue | 9 parts |
| Vinyl chloride/vinyl acetate copolymer (Union Carbide Co., Ltd.; VROH) * Molecular weight: 15000 | 20 parts |
| Methyl ethyl ketone | 71 parts |

<Magenta Ink>

| | |
|---|---|
| Carmine 6B | 9 parts |
| Vinyl chloride/vinyl acetate copolymer (Union Carbide Co., Ltd.; VROH) * Molecular weight: 15000 | 20 parts |
| Methyl ethyl ketone | 71 parts |

<Yellow Ink>

| | |
|---|---|
| Disazo Yellow | 9 parts |
| Vinyl chloride/vinyl acetate copolymer (Union Carbide Co., Ltd.; VROH) * Molecular weight: 15000 | 20 parts |
| Methyl ethyl ketone | 71 parts |

COMPARATIVE EXAMPLE III-3

A color image was obtained from a thermal transfer recording medium in the same manner as described in Example III-1 except that the ink composition for the thermal transfer recording layer was changed to the following formulation.

<Cyan Ink>

| | |
|---|---|
| Phthalocyanin Blue | 9 parts |
| Vinyl chloride/vinyl acetate copolymer (Union Carbide Co., Ltd.; VAGH) * Molecular weight: 27000 | 20 parts |
| Colorless silica fine particles (Nihon Aerogel; Aerogel R972) | 4 parts |
| Methyl ethyl ketone | 67 parts |

<Magenta Ink>

| | |
|---|---|
| Carmine 6B | 9 parts |
| Vinyl chloride/vinyl acetate copolymer (Union Carbide Co., Ltd.; VAGH) * Molecular weight: 27000 | 20 parts |
| Colorless silica fine particles (Nihon Aerogel; Aerogel R972) | 4 parts |
| Methyl ethyl ketone | 67 parts |

<Yellow Ink>

| | |
|---|---|
| Disazo Yellow | 9 parts |
| Vinyl chloride/vinyl acetate copolymer (Union Carbide Co., Ltd.; VAGH) * Molecular weight: 27000 | 20 parts |
| Colorless silica fine particles (Nihon Aerogel; Aerogel R972) | 4 parts |
| Methyl ethyl ketone | 67 parts |

COMPARATIVE EXAMPLE III-4

A color image was obtained from a thermal transfer recording medium in the same manner as described in Example III-1 except that the ink composition for the thermal transfer recording layer was changed to the following formulation.

<Cyan Ink>

| | |
|---|---|
| Phthalocyanin Blue | 9 parts |
| Vinyl chloride/vinyl acetate copolymer (Union Carbide Co., Ltd.; VYES-4) * Molecular weight: 5500 | 20 parts |
| Colorless silica fine particles (Nihon Aerogel; Aerogel R972) | 4 parts |
| Methyl ethyl ketone | 67 parts |

<Magenta Ink>

| | |
|---|---|
| Carmine 6B | 9 parts |
| Vinyl chloride/vinyl acetate copolymer (Union Carbide Co., Ltd.; VYES-4) * Molecular weight: 5500 | 20 parts |
| Colorless silica fine particles (Nihon Aerogel; Aerogel R972) | 4 parts |
| Methyl ethyl ketone | 67 parts |

<Yellow Ink>

| | |
|---|---|
| Disazo Yellow | 9 parts |
| Vinyl chloride/vinyl acetate copolymer (Union Carbide Co., Ltd.; VYES-4) * Molecular weight: 5500 | 20 parts |
| Colorless silica fine particles (Nihon Aerogel; Aerogel R972) | 4 parts |
| Methyl ethyl ketone | 67 parts |

COMPARATIVE EXAMPLE III-5

A color image was obtained from a thermal transfer recording medium in the same manner as described in Example III-1 except that the ink composition for the thermal transfer recording layer was changed to the following formulation.

<Cyan Ink>

| | |
|---|---|
| Phthalocyanin Blue | 4 parts |
| Vinyl chloride/vinyl acetate copolymer (Union Carbide Co., Ltd.; VROH) * Molecular weight: 15000 | 20 parts |
| Colorless silica fine particles (Nihon Aerogel; Aerogel R972) | 4 parts |
| Methyl ethyl ketone | 72 parts |

<Magenta Ink>

| | |
|---|---|
| Carmine 6B | 4 parts |
| Vinyl chloride/vinyl acetate copolymer (Union Carbide Co., Ltd.; VROH) * Molecular weight: 15000 | 20 parts |
| Colorless silica fine particles (Nihon Aerogel; Aerogel R972) | 4 parts |
| Methyl ethyl ketone | 72 parts |

<Yellow Ink>

| | |
|---|---|
| Disazo Yellow | 4 parts |
| Vinyl chloride/vinyl acetate copolymer (Union Carbide Co., Ltd.; VROH) * Molecular weight: 15000 | 20 parts |
| Colorless silica fine particles (Nihon Aerogel; Aerogel R972) | 4 parts |
| Methyl ethyl ketone | 72 parts |

COMPARATIVE EXAMPLE III-6

A color image was obtained from a thermal transfer recording medium in the same manner as described in Example III-1 except that the ink composition for the thermal transfer recording layer was changed to the following formulation.

<Cyan Ink>

| | |
|---|---|
| Phthalocyanin Blue | 15 parts |
| Vinyl chloride/vinyl acetate copolymer (Union Carbide Co., Ltd.; VROH) * Molecular weight: 15000 | 20 parts |

-continued

| | |
|---|---|
| Colorless silica fine particles (Nihon Aerogel; Aerogel R972) | 4 parts |
| Methyl ethyl ketone | 61 parts |

<Magenta Ink>

| | |
|---|---|
| Carmine 6B | 15 parts |
| Vinyl chloride/vinyl acetate copolymer (Union Carbide Co., Ltd.; VROH) * Molecular weight: 15000 | 20 parts |
| Colorless silica fine particles (Nihon Aerogel; Aerogel R972) | 4 parts |
| Methyl ethyl ketone | 61 parts |

<Yellow Ink>

| | |
|---|---|
| Disazo Yellow | 15 parts |
| Vinyl chloride/vinyl acetate copolymer (Union Carbide Co., Ltd.; VROH) * Molecular weight: 15000 | 20 parts |
| Colorless silica fine particles (Nihon Aerogel; Aerogel R972) | 4 parts |
| Methyl ethyl ketone | 61 parts |

The images obtained in examples III-1 to III-6, Comparative Examples III-1 to III-6 were evaluated in the same manner as described above on the image tone reproduction, image concentration, light resistance and fixability thereof. The results are shown in the following Table 3.

TABLE 3

| Physical properties | | Gradation reproduction | Image density | Light resistance | Fixability |
|---|---|---|---|---|---|
| Invention | III-1 | ○ | ○ | ○ | ○ |
| | III-2 | ○ | ○ | ○ | ○ |
| | III-3 | ○ | ○ | ○ | ○ |
| | III-4 | ○ | ○ | ○ | ○ |
| | III-5 | ○ | ○ | ○ | ○ |
| | III-6 | ○ | ○ | ○ | ○ |
| Comparative example | III-1 | X | ○ | ○ | ○ |
| | III-2 | X | ○ | ○ | ○ |
| | III-3 | X | ○ | ○ | X |
| | III-4 | X | ○ | X | ○ |
| | III-5 | X | X | ○ | ○ |
| | III-6 | ○ | ○ | ○ | X |

As shown in Table 3, according to the thermal recording medium obtained in Example III-1 of this invention, it was possible to produce a color image which was excellent in fidelity regarding the tone reproduction throughout entire regions including the highlight portion and the shadow portion as well as in durability of image after printing. In particular, it is possible according to this thermal transfer recording medium to realize the sharp cutting of the transfer recording layer on the occasion of thermal transferring, and to obtain a transfer image which is high in optical density, thus making it possible to achieve the objects of this invention.

Furthermore, the following results were obtained in the embodiments of Examples III-2 to III-7.

Namely, the image obtained in Example III-2 exhibited almost the same imaging property as that of Example III-1 and was particularly excellent in alcohol resistance test (water/ethanol=1/1; dipping for 12 hours). Specifically, while the image obtained in Example III-1 was highly resistive to peel-off, the image obtained in Example III-2 was found highly resistive to any changes in features or quality of image.

The image obtained in Example III-3 exhibited almost the same property as that of Example III-1.

The image obtained in Example III-4 exhibited excellent properties regarding the fastness of letter and bar code portions in addition to the same property as that of Example III-1.

The image obtained in Example III-5 was found excellent in the respect that it was possible to obtain an excellent transferred body provided with a releasing layer functioning also as a protective layer.

The image obtained in Example III-6 was provided on the surface thereof with a protective layer, and the transferred body thus obtained was also provided with a hologram, thus enhancing the security thereof.

As explained above, it is possible according to this invention to form an image excellent in tone reproduction based on areal gradation by means of thermal transferring. Additionally, the image obtained after the transferring thereof is excellent in shelf-life, light resistance and mechanical strength.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal transfer recording medium comprising, on a support, a thermal transfer recording layer containing, as a main constituent, a coloring pigment, an amorphous organic polymer and colorless or light-colored silica fine particles, wherein said pigment has an average particle diameter ranging from 50 nm to 500 nm, wherein said polymer is selected from an epoxy resin having a softening point ranging from 70–150° C., an epoxy equivalent ranging from 600 to 5000 and a weight average molecular weight ranging from 800 to 5000, an acrylic resin having a glass transition temperature ranging from 40 to 100° C. and a weight average molecular weight ranging from 2000 to 50000, and a vinyl chloride/vinyl acetate co-polymer having vinyl chloride units and vinyl acetate units and a weight average molecular weight ranging from 10000 to 20000, wherein said colorless or light-colored silica fine particles have an average particle diameter ranging from 10 nm to 300 nm, and the average particle diameter of the silica particles is smaller than the average particle size of the pigment to impart a sharp, cutting property to the recording layer, and wherein said recording layer has a thickness of 0.2 $\mu$m to 1.0 $\mu$m and contains the coloring pigment, the amorphous organic polymer and the silica fine particles at a ratio of 20–60 parts by weight: 40–70 parts by weight: 1–30 parts by weight.

2. The recording medium according to claim 1, wherein said copolymer further comprises 1 to 5% by weight of maleic acid units, the balance being constituted by the vinyl chloride units and vinyl acetate units.

3. The recording medium according to claim 1, wherein said recording layer contains said pigment in an amount of 20 to 30% by weight based on the total weight.

4. The recording medium according to claim 1, wherein said recording layer contains said main constituent in an amount of at least 90% by weight.

5. The recording medium according to claim 1, wherein said support has an elongated configuration, and said recording layer comprises a yellow region, a magenta region and a cyan region, which are successively arrayed along the longitudinal direction of said support.

6. The recording medium according to claim 1, wherein said substrate has an elongated configuration, and said recording layer comprises yellow region, magenta region, cyan region and a black region, which are successively arrayed along the longitudinal direction of said support.

7. A method of forming an image by means of a thermal head printer, by using a thermal transfer recording medium as claimed in claim 1, said method comprising thermally transferring, in accordance with image data, the thermal transfer recording layer to an image-receiving sheet having an image-receiving surface by means of a thermal head printer to thereby form an areal gradation image, wherein said image-receiving surface of the image-receiving sheet is constituted by the same kind of amorphous organic polymer as the amorphous organic polymer included in the thermal transfer recording layer.

8. An image-bearing body comprising an image carrier, and an image region formed on said image carrier, wherein said image region is formed using a thermal transfer recording layer of a thermal transfer recording medium as claimed in claim 1.

* * * * *